US007887462B1

(12) United States Patent
Bearden

(10) Patent No.: US 7,887,462 B1
(45) Date of Patent: Feb. 15, 2011

(54) HAND EXERCISE DEVICE

(76) Inventor: David Gordon Bearden, P.O. Box 1831, Shelbyville, TN (US) 37162

( * ) Notice: Subject to any disclaimer, the term of this patent is extended or adjusted under 35 U.S.C. 154(b) by 0 days.

(21) Appl. No.: 12/943,194

(22) Filed: Nov. 10, 2010

Related U.S. Application Data

(63) Continuation-in-part of application No. 12/422,728, filed on Apr. 13, 2009.

(51) Int. Cl.
*A63B 23/14* (2006.01)
*A63B 21/00* (2006.01)
*A63B 15/02* (2006.01)
*A41D 19/00* (2006.01)

(52) U.S. Cl. ..... 482/44; 482/1; 482/47; 2/160

(58) Field of Classification Search ..... 482/1, 482/44, 47–48, 148, 51, 92, 124, 83; 600/9, 600/15, 75; 607/1; 601/40, DIG. 4; 81/44; 2/160–163
See application file for complete search history.

(56) References Cited

U.S. PATENT DOCUMENTS

| | | | | |
|---|---|---|---|---|
| 3,421,500 | A | 1/1969 | Jacobson | |
| 3,583,392 | A * | 6/1971 | Frieberger et al. | 600/500 |
| 3,834,702 | A * | 9/1974 | Bliss | 463/6 |
| 4,021,054 | A * | 5/1977 | Csutor | 280/825 |
| 4,034,979 | A | 7/1977 | Wester | |
| 4,109,909 | A * | 8/1978 | Csutor | 482/51 |
| 4,131,196 | A * | 12/1978 | Csutor | 206/278 |
| 4,678,181 | A | 7/1987 | Ditsch et al. | |
| 4,750,734 | A | 6/1988 | Greenfield | |
| 5,014,981 | A | 5/1991 | Prelich | |
| 5,062,625 | A | 11/1991 | Vonk | |
| 5,580,336 | A | 12/1996 | Coallier | |
| 5,720,046 | A * | 2/1998 | Lopez et al. | 2/159 |
| 5,738,613 | A | 4/1998 | Clayton | |
| 5,743,835 | A * | 4/1998 | Trotter | 482/57 |
| 5,950,239 | A * | 9/1999 | Lopez | 2/115 |
| 5,989,178 | A | 11/1999 | Chiu | |
| 6,050,931 | A * | 4/2000 | Russell | 600/15 |
| 6,119,271 | A | 9/2000 | Byon | |
| 6,213,918 | B1 | 4/2001 | Rogers, Jr. | |
| 6,258,020 | B1 * | 7/2001 | Lopez | 600/15 |
| 6,543,769 | B1 * | 4/2003 | Podoloff et al. | 273/148 B |
| 7,052,447 | B2 * | 5/2006 | Whittaker | 482/124 |
| 7,121,983 | B1 | 10/2006 | Trent | |
| 7,314,434 | B2 * | 1/2008 | Chen | 482/63 |
| 7,363,660 | B1 | 4/2008 | Gilliland et al. | |
| 7,381,156 | B2 | 6/2008 | Silagy | |
| 2006/0185057 | A1 | 8/2006 | Terpinski | |
| 2010/0261581 | A1 * | 10/2010 | Bearden | 482/47 |

* cited by examiner

*Primary Examiner*—Steve R Crow
(74) *Attorney, Agent, or Firm*—James Addison Barry, Jr.

(57) ABSTRACT

A hand exercise device 100 and method for exercising human hands 102 and digits 104 comprising a plurality of separate digit sleeves 110 wherein the diameter and length are such that the separate digit sleeves 110 slide over finger and thumb digits 105, 106 of a human hand 102; a magnetic element 120 is attached with the separate digit sleeve 110 at or near a distal end 116 of the separate digit sleeve 110, wherein the magnetic element 120 will facilitate a desired exercise in multidirectional movements when the magnetic element 120 is approximated near another magnetic 129 or ferrous metal surface 150. The hand exercise device may include a flat or wavy ferrous material 150, 151, 152 or a randomly disposed magnetic field 161 to aid in exercising the hand.

13 Claims, 7 Drawing Sheets

HAND EXERCISE DEVICE

CROSS-REFERENCE TO RELATED APPLICATIONS

The present application is a Continuation-In-Part of the parent U.S. patent application Ser. No. 12/422,728, filed Apr. 13, 2009, titled Hand Exercise Device, currently pending. The present application is related by the same inventor for both applications, David Gordon Bearden. The parent application U.S. patent application Ser. No. 12/422,728, filed Apr. 13, 2009 is hereby incorporated in its entirety by reference.

FIELD OF INVENTION

The present invention relates to hand exercise device and methods. More specifically, the hand exercise device and method uses magnetic attractive and repulsive forces for increasing strength, improving function, and providing rehabilitation to the muscles, soft tissues of the fingers, wrists, hands, and forearms of the human arm.

BACKGROUND OF INVENTION

Hand exercisers are a well-known method of exercising the muscles of the fingers, hands, wrists, and forearms to increase the strength/function of these body parts along with rehabilitating the soft tissue (cartilage, ligaments, tendons, nerves) but these hand exercisers have fallen short in many aspects. Previous references that produce an exercise/rehabilitation component typically teach a mechanical means of resistance such as a spring, elastic webbing, rubber band, pulley with weights, elastic bands, loops that fit over the distal end of the fingers that are connected with elastic bands, or a simple rubber ball, but few have shown or proposed that the resistant force could be produced by a means other than a physical resistance, such as a magnetic field. These previous reference devices have used many types of resistance methods that provide the desired exercise, but many have been limited by their mechanical design to provide only a benefit to one group of muscles such as the flexor or extensor muscle groups. U.S. Pat. No. 4,678,181 to Ditsh, et al. discloses a hand exerciser that limits the user to a flexion contraction only. U.S. Pat. No. 5,062,625 to Vonk limits the user to an extension contraction only. U.S. Pat. No. 4,750,734 to Greenfield and U.S. Pat. No. 7,121,983 to Trent both depict a deformable elastic webbing that is attached to a rigid outer frame to hold the elastic webbing tight within a rigid frame, where the user inserts their fingers into openings that are formed within the elastic webbing material to perform the desired exercise against the resistance of the webbing. The fingers can then be exercised in not only flexion/extension exercises, but can also be exercised in abduction/adduction movements. These types of exercisers are a definite improvement over exercisers that offer a one-dimensional exercise, such as only flexion, or only extension.

There are a few previous references to gloves with a magnetic element. U.S. Pat. No. 7,363,660 to Gilliland teaches a modified work glove featuring a magnetic tip that may make it easier to pick up and hold small metal objects by way of a magnet contained in the tip of the glove finger. U.S. Pat. Appl. No. 20060185057 by Terpinski uses a stretchy material to form what is called a finger glove, with a mounted magnet at the distal end of the finger glove. The Magnetic Finger is designed for use in the automotive industry to hold small ferrous metal parts such as nuts, bolts, screws along with other small metallic parts when they are being installed to avoid dropping them, or in a confined area where the entire hand or more than one finger could not be used to install the part. Both Gilliland and Terpinski use a single magnet for attracting and holding a small metal part. In addition U.S. Pat. No. 6,050,931 to Russell teaches a stretchable strap with small permanent magnets that may be strapped around the hand for easing pain and healing effects. U.S. Pat. No. 5,989,178 teaches a magnetic ring worn on the little finger of the hand, around all of the fingers of the hand, or around all of the toes of the foot for aiding circulation in the body. U.S. Pat. No. 3,421,500 to Jacobson discusses a portable orthopedic device that is referred to as a glove with magnetic elements but is a mitten with all fingers moving together. This mitten employs magnetic forces to flex and rehabilitate body members. However, Jacobson does not provide for moving or exercising individual fingers, nor does it utilize an opposable thumb to accomplish a higher level of reconditioning for the human hand.

In the health and exercise field, a device and method are needed that utilizes a magnetic force capable of exercising individual digits of the hand for multiple types of exercises for the hand, fingers, wrist, and forearms of the human arm.

SUMMARY

It is a primary aspect of this invention to provide a hand exercise device that utilizes magnetic force capable of exercising individual digits of the hand for multiple types of exercises of the hand, fingers, wrist, and forearms of the human arm. In addition, the hand exercise device provides a method for exercising the hand, fingers, wrist, and forearms of the human arm.

This invention in one embodiment comprises a hand exercise device for exercising human hands and digits that comprises: a plurality of separate digit sleeves wherein the diameter and length are such that the separate digit sleeves slide over individual digits of the human hand; a magnetic element is attached with each separate digit sleeve near a distal end of each separate digit sleeve, wherein a first magnetic element facilitates a desired exercise with multidirectional movements when the first magnetic element is approximated near a second magnetic element. Another embodiment may include separate digit sleeves in the form of a splint. Yet another embodiment of the hand exercise device may include the finger separate digit sleeve with the magnetic element such that a magnet and a thumb separate digit sleeve has at least two magnetic elements that are magnets and one of the at least two magnets of the thumb separate digit sleeve is a like polarity as the magnet of the finger separate digit sleeve and the other of the at least two magnetic elements of the thumb separate digit sleeve is an opposite polarity from the magnet of the finger separate digit sleeve wherein the thumb separate digit sleeve may be rotated approximately 180 degrees on the thumb digit such that a repulsive force may be changed to an attractive force and the attractive force may be changed to the repulsive force dependent upon the orientation of the thumb separate digit sleeve.

The hand exercise device in another embodiment may include separate digit sleeves in the form of a glove. Yet another embodiment of the hand exercise device may include magnetic elements that are magnets and one of the separate digit sleeves is a thumb separate digit sleeve for a thumb, and the thumb separate digit sleeve magnet is attached with the thumb separate digit sleeve and orientated with an opposite polarity with the magnets for finger separate digit sleeves for finger digits such that the magnet for the thumb separate digit sleeve is attracted with the magnet for the finger separate digit sleeve such that an extension contraction exercise is produced when the thumb separate digit sleeve and the finger separate digit sleeves are pulled apart. Still another embodiment may include the hand exercise device wherein the magnetic elements are magnets and wherein one of the separate digit sleeves is a thumb separate digit sleeve for a thumb, and the thumb separate digit sleeve magnet is attached with the thumb separate digit sleeve and orientated with a like polarity with the magnets for finger separate digit sleeves for finger digits such that the magnet for the thumb separate digit sleeve is repulsed with the magnet for the finger separate digit sleeve such that an erratic flexion contraction exercise is produced when the thumb separate digit sleeve and the finger separate digit sleeves are moved toward each other. A further embodiment of the hand exercise device may include the magnetic element attached with the separate digit sleeve with a cavity wherein the cavity allows the interchange of the magnetic elements for adjusting the magnetic element's strength between weak and strong.

Another embodiment may include a hand exercise device wherein one of the magnetic elements is a flat ferrous metal surface such that a resistance is facilitated for the movement of the human hand with digits or wherein one of the magnetic elements is a waveform ferrous metal surface such that a resistance is facilitated for the movement of the human hand with digits.

The hand exercise device may also comprise provisions of a method for exercising with a hand exercise devise comprising the steps of: inserting a finger digit in the finger separate digit sleeve; inserting a thumb digit in the thumb separate digit sleeve; moving the finger digit with the finger separate digit sleeve and the thumb digit with the thumb separate digit sleeve together; and moving the finger digit with the finger separate digit sleeve and the thumb digit with the thumb separate digit sleeve apart wherein the movement of the separate digit sleeves with magnetic elements provide for exercise, strength, and rehabilitation of the fingers, hands, wrists and forearms. Another embodiment of a method may include exercising wherein the magnetic element of the finger separate digit sleeve and the magnetic element of the thumb separate digit sleeve are of opposite polarity wherein the step of moving the finger digit and the thumb digit together by attractive forces is a pulling apart motion for extension exercises. Still another method may include exercising wherein the magnetic element of the finger separate digit sleeve and the magnetic element of the thumb separate digit sleeve are of like polarity wherein the step of moving the finger digit and the thumb digit together against the repulsive forces of the magnetic element is an erratic flexion motion for exercise. Yet another method may include exercising wherein one of the magnetic elements is a flat ferrous metal surface and the method of exercising includes the steps of: placing the finger separate digit sleeves with the finger digit and the thumb separate digit sleeve with the thumb digit on the flat ferrous metal surface and moving the finger digits as well as the thumb digit together and apart.

A further embodiment of a method of exercising with a hand exercise device may include the steps of: inserting a finger digit of a first hand in the finger separate digit sleeve; inserting a thumb digit of the first hand in the thumb separate digit sleeve; inserting the finger digit of a second hand in the finger separate digit sleeve; inserting a thumb digit of the second hand in the thumb separate digit sleeve; moving the first hand with the finger digit with the finger separate digit sleeve and the thumb digit with the thumb separate digit sleeve toward the second hand with the finger digit with the finger separate digit sleeve and the thumb digit with the thumb separate digit sleeve wherein the magnetic elements with the first hand are in a like polarity with the magnetic elements of the second hand wherein the movement of the hands with the separate digit sleeves with magnetic elements provide for exercise, strength, and rehabilitation of the fingers, hands, wrists and forearms.

Another embodiment of a method for exercising with a hand exercise device may comprise the steps of: inserting a finger digit of a first hand in the finger separate digit sleeve; inserting a thumb digit of the first hand in the thumb separate digit sleeve; inserting the finger digit of a second hand in the finger separate digit sleeve; inserting a thumb digit of the second hand in the thumb separate digit sleeve; moving the first hand with the finger digit with the finger separate digit sleeve and the thumb digit with the thumb separate digit sleeve toward the second hand with the finger digit with the finger separate digit sleeve and the thumb digit with the thumb separate digit sleeve wherein the magnetic elements with the first hand are in an opposite polarity with the magnetic elements of the second hand wherein the movement of the hands with the separate digit sleeves with magnetic elements provide for exercise, strength, and rehabilitation of the fingers, hands, wrists and forearms.

Yet another embodiment of a method for exercising with a hand exercise device wherein one of the magnetic elements is a waveform ferrous metal surface, the method may further comprise the steps of: inserting a finger digit in the finger separate digit sleeve; inserting a thumb digit in the thumb separate digit sleeve; placing the finger separate digit sleeves with the finger digit and the thumb separate digit sleeve with the thumb digit on the waveform ferrous metal surface; and moving the finger digits with the finger separate digit sleeves and the thumb digit with the thumb separate digit sleeve across the wave form ferrous metal surface.

Another embodiment of the hand exercise device for exercising human hands and thumb and finger digits includes a magnetic turntable further comprising: an upper structural portion and a lower structural portion attached with a bearing such that the upper structural portion turns while the lower structural portion remains stationary; and the upper structural portion further comprises a top surface and multiple magnets randomly disposed and embedded in the top surface of the upper structural portion such that the top surface and the multiple magnets randomly disposed form a smooth top surface such that the digit does not engage ridges or valleys as the hand moves across the smooth top surface while exercising the hand and digit. An embodiment may further include the bearing adjustable for varying a force required to turn the upper structural portion in relation to the lower structural portion.

Yet another embodiment may include a hand exercise device for exercising human hands and thumb and finger digits including: at least one separate digit sleeve wherein the at least one separate digit sleeve diameter and length are such that the at least one separate digit sleeve slides over at least one digit of the hand; wherein the at least one separate digit sleeve is in a form of a splint; a magnetic element is attached with each separate digit sleeve at a distal end of the each separate digit sleeve, wherein a first magnetic element facilitates a desired exercise with multidirectional movements when the first magnetic element is approximated near a second magnetic element. An embodiment may further include the hand exercise device in combination with a randomly disposed magnetic field including: a top surface and multiple randomly disposed magnets wherein the multiple said randomly disposed magnets are embedded in the top surface such that as the at least one separate digit sleeve moves from one said randomly disposed magnet to the next said randomly disposed magnet a snap force occurs for exercising the hand and the digits. In addition, the hand exercise device randomly disposed magnetic field may further include: an upper structural portion and a lower structural portion attached with a bearing such that the upper structural portion turns while the lower structural portion remains stationary; and the upper structural portion comprises the top surface and the multiple said randomly disposed magnets are embedded in the top surface of the upper structural portion such that the top surface and the multiple said randomly disposed magnets form a smooth top surface such that the digit does not engage ridges or valleys as the hand moves across the smooth top surface while exercising the hand and the digit.

A method for exercising with the hand exercise devices may include the steps of: inserting the at least one digit in the at least one separate digit sleeve; placing the hand with the at least one separate digit sleeve in a magnetic proximity of the randomly disposed magnetic field; and moving the at least one separate digit sleeve in a forward and aft motion from one said randomly disposed magnetic field to a next said randomly disposed magnetic field such that snap forces are created in the digit and provide for exercise, strength, and rehabilitation of the digit, and the hands. Another method for exercising may further include the at least one digit in the at least one separate digit sleeve being at least two digits in at least two separate digit sleeves and wherein the moving the at least one separate digit sleeve in the forward and aft motion from the one said randomly disposed magnetic field to the next said randomly disposed magnetic field step is a walking the digits type of motion wherein one of the separate sleeves is moved forward and then a next separate sleeve is moved forward and the one of the separate sleeves is moved aft and then the next separate sleeve is moved aft wherein this forward and aft motion comprises another step of rotating the upper structural portion of the randomly disposed magnetic field. Yet another method may further include the bearing being adjustable for varying a force required to rotate the upper structural portion in relation to the lower structural portion, further including an additional step of adjusting the bearing for adjusting the force required to rotate the upper structural portion of the randomly disposed magnetic field.

Another embodiment of a method for exercising with a hand exercise device may comprise the steps of: inserting the at least one digit in the at least one separate digit sleeve; placing the hand with the at least one separate digit sleeve in a magnetic proximity of the randomly disposed magnetic field; and moving the at least one separate digit sleeve in a side to side motion from one said randomly disposed magnetic field to a next said randomly disposed magnetic field such that snap forces are created in the at least one digit and provide for exercise, strength, and rehabilitation of the digits, and the hands. Another method may further include the at least one digit in the at least one separate digit sleeve including at least two digits in at least two separate digit sleeves and wherein the moving the at least one separate digit sleeve in the side to side motion from the one said randomly disposed magnetic field to the next said randomly disposed magnetic field step is a side stepping the digits type of motion wherein one of the separate sleeves is moved to a side then a next separate sleeve is moved to the side and then the one of the separate sleeve is moved to the side, repeating the side to side motion wherein the side to side motion comprises another step of rotating the upper structural portion of the randomly disposed magnetic field.

Yet another embodiment of a method for exercising with a hand exercise device may comprise the steps of: inserting the at least one digit in the at least one separate digit sleeve; placing the hand with the at least one separate digit sleeve in a magnetic proximity of the randomly disposed magnetic field; and moving the randomly disposed magnetic field by rotating the upper structural portion such that snap forces are created in the at least one digit providing exercise, strength, and rehabilitation of the digits, and hands for users with limited capability of movement of the digit. Another embodiment of the method may further include the at least one digit in the at least one separate digit sleeve being at least two digits in at least two separate digit sleeves and wherein the moving the randomly disposed magnetic field by rotating the upper structural portion step is a forward and aft motion from one randomly disposed magnetic field to a next randomly disposed magnetic field further includes a step of rotating the upper structural portion of the randomly disposed magnetic field such that the at least two separate digit sleeves is moved forward and then a next separate digit sleeve is moved forward and one of the separate sleeves is moved aft and then another separate sleeve is moved aft due to the placing of the hand over the randomly disposed magnetic field and the rotation of the randomly disposed magnetic field. Still another embodiment of the method may further include the at least one digit in the at least one separate digit sleeve is at least two digits in at least two separate digit sleeves and wherein the moving the randomly disposed magnetic field by rotating the upper structural portion step creates a side to side motion from one randomly disposed magnetic field to a next randomly disposed magnetic field further includes a step of rotating the upper structural portion of the randomly disposed magnetic field such that the at least two separate digit sleeves is moved sideward and then a next separate digit sleeve is moved sideward due to the placing of the hand over the randomly disposed magnetic field and the rotation of the randomly disposed magnetic field.

Another embodiment of a method for exercising a hand and digits of the hand with a means for hand exercise with magnet forces, a means for securing a magnet on a distal end of the digit and a randomly disposed magnetic field, may comprise the steps of: inserting at least one digit in at least one means for securing a magnet on the distal end of the digit; placing the hand with the means for securing the magnet on the distal end of the digit in a magnetic proximity of the randomly disposed magnetic field; and moving the means for securing the magnet on the distal end of the digit in a forward and aft motion from a first randomly disposed magnetic field to a next randomly disposed magnetic field such that snap forces are created in the digit and provide exercise, strength, and rehabilitation of the digits, and hands.

BRIEF DESCRIPTION OF THE DRAWINGS

These and other features, aspects, and advantages of the invention will become better understood with regard to the following description, appended claims, and accompanying drawings where:

DETAILED DESCRIPTION OF THE INVENTION

Figure 1:
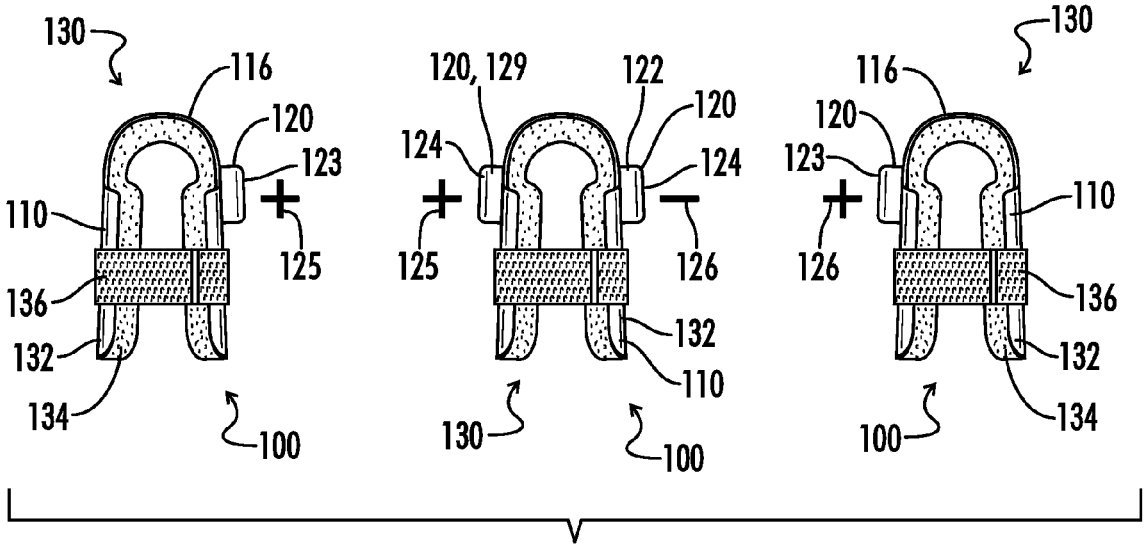
FIG. 1 is a side view of one embodiment of the splint type hand exercise device depicting two finger sleeves and one thumb sleeve.
Figure 2:
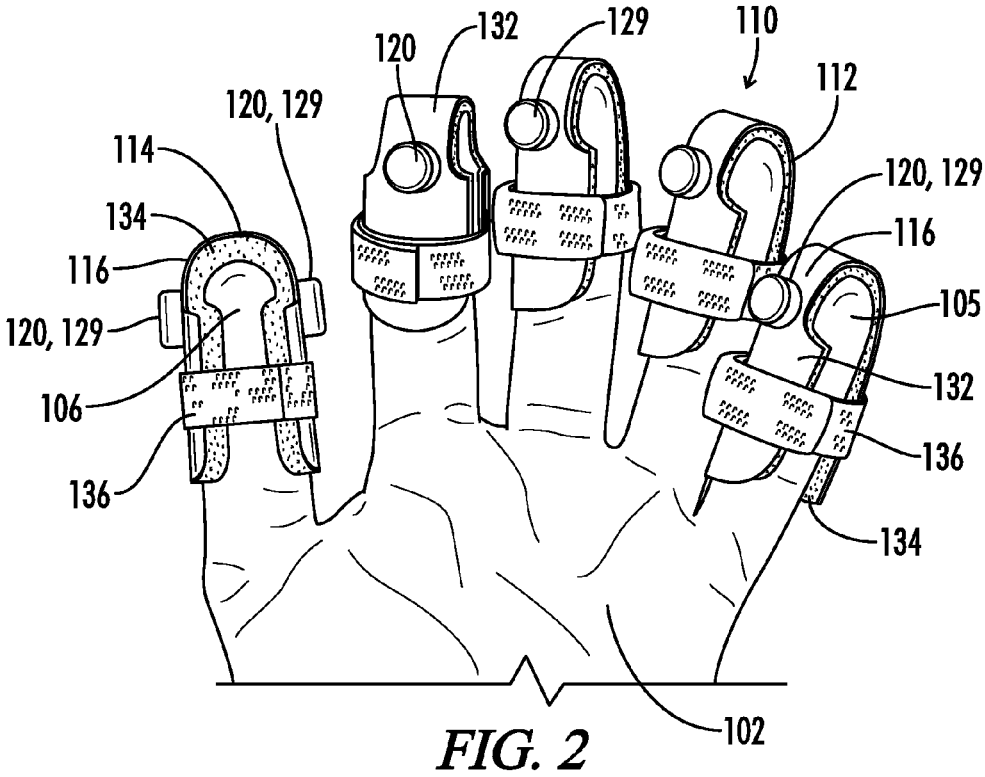
FIG. 2 is a perspective view of one embodiment of the splint type hand exercise device placed on the human hand depicting four finger sleeves and one thumb sleeve.

The present invention relates to the field of hand exercisers, and provides a means for exercising the fingers, hands, wrists and forearms with magnetic forces. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

A separate digit sleeve is defined as allowing each digit, fingers and thumb to be exercised separate or independently from the other digit. When each individual finger cannot move individually, but must moved as a unit, the stronger finger or fingers will continue to get stronger with an increased range of motion, while the weaker finger or fingers will continue to stay weak, because the stronger finger or fingers will be performing the majority of the exercise. To accomplish the desired exercises and rehabilitation, each individual digit should be exercised on an individual basis to achieve the desired results. The separate digit sleeves may be joined together as a glove as long as the digits are allowed to move individually for individual motion and exercise of the digits. In addition, the use of a magnet attached with each separate and independent digit sleeve allows for multidirectional movement of the digits including the thumb. The thumb performs very important functions with the exercise of the fingers, hands, wrists, and forearms by the fact that the human hands have opposable thumbs. These thumbs can completely and thoroughly exercise, rehabilitate and strengthen the human hand to perform and function at the peak capacity but this requires the use of all the finger digits and the opposing thumb digit operating independently to accomplish and regain the ultimate level of reconditioning on an individual basis. In lieu of a magnet combined with the thumb, the finger with the sleeve magnet may be used with a magnetic turntable or a piece of material with a magnetic field for exercising the hand.

Plyometrics is defined as a type of exercise training designed to produce fast, powerful movements, and improve the functions of the nervous system as it relates to the muscle being exercised. Plyometric movements, in which the fibers of a muscle are loaded and then contracted in rapid sequence, use the strength, elasticity and innervations of muscle and surrounding tissues to accomplish this type of exercise, depending on the desired training goal. Plyometric training involves practicing plyometric movements to toughen tissues and train nerve cells to stimulate a specific pattern of muscle contraction so the muscle generates as strong a contraction as possible in the shortest amount of time. A plyometric contraction involves first a rapid muscle lengthening movement (eccentric phase), followed by a short resting phase (amortization phase), then an explosive muscle shortening movement (concentric phase), which enables muscles to work together in doing the particular motion. Plyometric training engages the myotatic reflex, which is the automatic contraction of muscles when their stretch sensory receptors are stimulated. Plyometric exercises use explosive force to develop muscular power. The present invention has found a way to use magnets to create this explosive force. The explosive force is very similar to a snap action created by one field of a magnet such as a positive pole being attracted to an opposite field magnet such as a negative pole magnet. As the positive pole of the magnet is forced away from one negative pole magnet toward another negative pole magnet, at a point between the two negative pole magnets, the second negative pole magnet pulls the positive pole magnet with a greater force than the first. This transfer of forces produces a snap reaction or a snap force that can be used effectively for hand and finger therapy and exercise.

Erratic is defined as having no fixed course, wandering, not consistent, deviating from the ordinary, and moving in ways that are not expected. The following helps to illustrate this. When the magnets with the digit sleeves are in a like pole, and then approximated towards each other, the inherent energy of the magnetic field will cause the digits to be repulsed away from each other when the digits are performing the flexion contraction exercise. This magnetic repulsion force will result in erratic, unpredictable movements of the digits that cannot be predicted or expected, that will produce exercise for the flexor muscle groups of the digits in the human hand in multidirectional movements. The user may turn the digit sleeves, approximately 180° to exercise the extensor muscle groups of the human hand. Whereas hand exercise devices that use mechanical means for resistance to exercise are predictable, and consistent in the direction that the digits can be moved in to produce the desired exercise. When using the non-mechanical means of magnetic forces of the current hand exercise device with magnetic elements to provide this erratic resistance for exercise, it will cause the muscles and/or soft tissue of the human hand to move in directions that are inconsistent, cannot be predicted, or expected. The fingers, wrists, hands, forearms, and the associated soft tissue of the human arm move in a wide range of motion. Many previous hand exercise devices are limited as to what range of motion is possible due to their mechanical design. When the main goal of the doctor, physical therapist or home user is to strengthen and/or rehabilitate the fingers, wrists, hands, forearms, associated soft tissue of the human arm it is desirable that these body parts are able to move in all of the ranges of motion that they were created to perform, which the current hand exercise device with magnetic elements allows by using a non-mechanical means in the form of magnetic energy.

A magnetic element is defined as any material which impart magnetic forces upon another material when brought within a magnetic field created by either or both of the materials. Therefore, the magnetic elements may be permanent magnets, or a permanent magnet in combination with a piece of material such as steel which is attracted or repelled in a magnetic field.

Overview of the Invention:

The hand exercise device 100 is an improved device as well as method for exercising, strengthening, and rehabilitating the muscles, along with the supporting soft tissue of the fingers, thumbs, hands, wrists, and forearms by using the inherent energy of magnets that provide both the attractive and repulsive forces with multidirectional movements for exercise, strength, and rehabilitation without the use of a mechanical means for resistive force to accomplish this action.

Figure 16A:
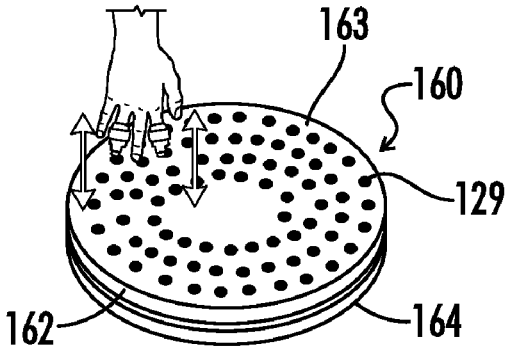
FIG. 16A is a perspective view of one embodiment of the splint type hand exercise device depicting a splint type hand exercise device exercising forward and aft movement with the magnetic turntable exercise device.
Figure 16B:
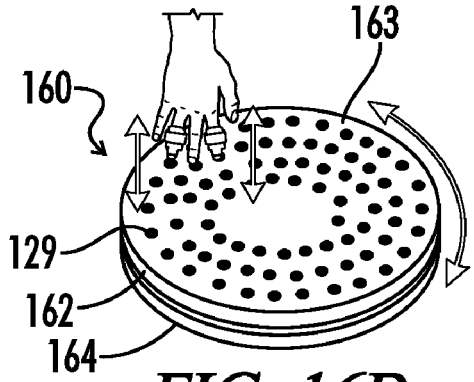
FIG. 16B is a perspective view of another embodiment of the splint type hand exercise device depicting a splint type hand exercise device exercising forward and aft movement with the magnetic turntable exercise device upper portion rotating.
Figure 17A:
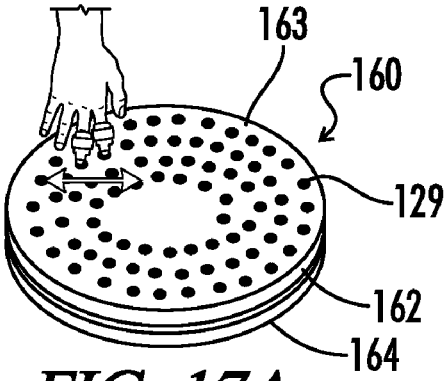
FIG. 17A is a perspective view of one embodiment of the splint type hand exercise device depicting a splint type hand exercise device exercising side to side movement with the magnetic turntable exercise device.
Figure 17B:
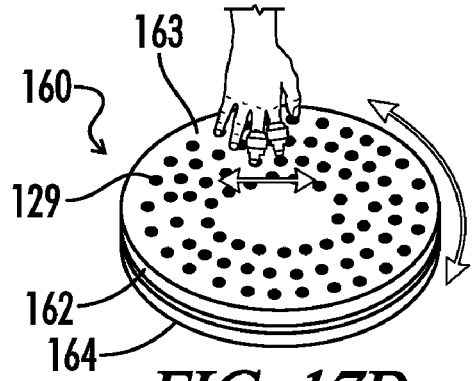
FIG. 17B is a perspective view of another embodiment of the splint type hand exercise device depicting a splint type hand exercise device exercising side to side movement with the magnetic turntable exercise device upper portion rotating.

As depicted in FIGS. 1 through 3B and 10 through 11, the hand exercise device 100 may comprise a plurality of separate digit sleeves 110 with at least one magnetic element 120 attached with each of the separate digit sleeves 110 on or near the distal end 116 of the separate digit sleeve 110. The separate digit sleeves 110 have a diameter and length such that the separate digit sleeves 110 slide over the individual finger digits 105 and thumb digit 106 of a human hand 102. The magnetic element 120 facilitates the desired exercise with multidirectional movements when the magnetic element 120 is approximated near another magnetic element 120. The method for exercising with the hand exercise device 100 may include but is not limited to inserting finger digits 105 in the finger separate digit sleeves 112, inserting thumb digits 106 in the thumb separate digit sleeve 114, moving the finger digits 105 with the finger separate digit sleeve 112 and the thumb digits 106 with the thumb separate digit sleeve 114 together, and moving the finger digits 105 with the finger separate digit sleeve 112 and the thumb digits 106 with the thumb separate digit sleeve 114 apart such that the movement of the separate digit sleeves 110 with the magnetic elements 120 provide for exercise, strength, and rehabilitation of the fingers, hands, wrists and forearms. Additional methods for hand and finger exercising may include but are not limited to one or more magnetic finger sleeves 110 on the hand 102 with at least one finger 105 walking or moving, forward and aft FIG. 16A or side to side FIG. 17A, across a field of magnets 129 randomly disposed on a top surface 163 wherein the randomly disposed magnetic elements 120 disposed on the top surface 163 may be moveable as illustrated in FIGS. 16B and 17B such as with multiple magnets 129 randomly disposed on a rotatable magnetic turntable 160.

Design Specifications:

When using typical mechanical means such as elastic material and spring types of resistance for opposition to exercise and for rehabilitation, the resistant force is predictable and consistent in a predictable line of movement. A means for hand exercise with magnet force includes the following devices. When using a non-mechanical means such as magnetic repulsion, the exercise and rehabilitation component is performed in an advantageous unpredictable erratic movement when the magnets 129 that are attached with the finger digit sleeves 112 are approximated to the magnet 129 attached with the thumb digit sleeve 114 and the magnets 129 are a like polarity 125. When the magnets 129 in the finger digit sleeves 112 are approximated to the magnet 129 in the thumb digit sleeve 114 are the like polarity 125 the energy field between the opposing forces will create an erratic type of exercise that cannot be achieved when using a mechanical means for resistance.

Moving the fingers 105 with magnetic separate digit sleeves 110 over an object such as a magnetic turntable 160 with multiple opposite pole magnets 129 disposed in a random pattern also creates an erratic force for exercise and additionally creates a snap force as previously mentioned such that as the finger sleeve magnetic force moves from one random placed magnet to the next random placed magnet as the fingers walk forward and aft or side to side, or as the magnetic turntable 160 with the random placed magnets is rotated, and the stronger magnetic attraction is moved from one magnet to the next causing the snap force to exercise the hand 102 and finger 105. Normally opposite magnetic polarities are used with embodiments including a randomly disposed magnetic force 161.

Another advantage of non-mechanical means for resistance in exercise and rehabilitation is that there are no mechanical parts involved in the exercise to fatigue or fail due to the fact that magnetic resistance is consistent in resistant forces whether in an attractive or a repulsive component. With the non-mechanical, magnetic resistance there is no elastic webbing, elastic rubber bands or any type of elastic material to crack or be stretched beyond the limits of the material while trying to provide the resistance that is needed to effectively exercise and rehabilitate the fingers, hands, wrists, and forearms of the human arm. The following include a means for securing a magnet 129 on or near a distal end 116 of a digit 105, 106.

The hand exercise device 100 includes but is not limited to a splint type 130 of hand exercise device and a glove type 140 of hand exercise device.

As illustrated in FIGS. 1 through 2 and 10A through 11 with the splint type 130 of digit sleeve hand exercise device 100, the separate digit sleeve 110 may include an aluminum finger splint 132 as the separate digit sleeve 110. A magnetic element 120 is attached with the separate digit sleeve 110 on or near the distal end 116 of the separate digit sleeve 110. One means of attaching the magnetic element 120 to the separate digit sleeve 110 is bonding the magnetic element 120 which may be a magnet 129 with the separate digit sleeve 110 or aluminum finger splint 132 with an adhesive. The magnetic element 120 may be a flexible, pliable magnetic strip 121 that wraps around, or follows the contour of, the distal end 116 of the splint type 130 of separate digit sleeve 110. A strip of hook and loop style fabric 136 or an elastic or rubber band may be used around the separate digit sleeve 110 to securely hold the separate digit sleeve 110 with the finger digit 105 and the thumb digit 106 of the human hand 102 that will keep the separate digit sleeve 110 from moving when exercising. In addition padding 134 may be bonded to the separate digit sleeve 110 for comfort while using the hand exercise devise 100 and to help secure the separate digit sleeve 110 in place in relation to the finger digit 105 or thumb digit 106 while exercising. One embodiment of the hand exercise device 100 may include a plurality of separate digit sleeves 110 wherein the diameter and length are such that the separate digit sleeves 110 slide over individual digits of the human hand 102 and the separate digit sleeves 110 are in the form of a splint 130. A magnetic element 120 is attached with each separate digit sleeve 110 on or near a distal end 116 of each separate digit sleeve 110, wherein the magnetic element 120 facilitates a desired exercise with multidirectional movements when the magnetic element 120 is approximated near a second magnetic element 122. One embodiment may include a finger separate digit sleeve 112 with at least one magnetic element 123 that is a magnet 129 and a thumb separate digit sleeve 114 has at least two magnetic elements 124 that are magnets 129 and one of the at least two magnets 124 of the thumb separate digit sleeve 114 is a like polarity 125 as the magnet 129 for the magnetic element 120 of the finger separate digit sleeve 112 and the other of the at least two magnetic elements 120 of the thumb separate digit sleeve 114 is an opposite polarity 126 from the magnet 129 of the finger separate digit sleeve 112 wherein the thumb separate digit sleeve 114 may be rotated approximately 180 degrees on the thumb digit 106 such that a repulsive force may be changed to an attractive force and the attractive force may be changed to the repulsive force dependent upon the orientation of the thumb separate digit sleeve 114.

Figure 3A:
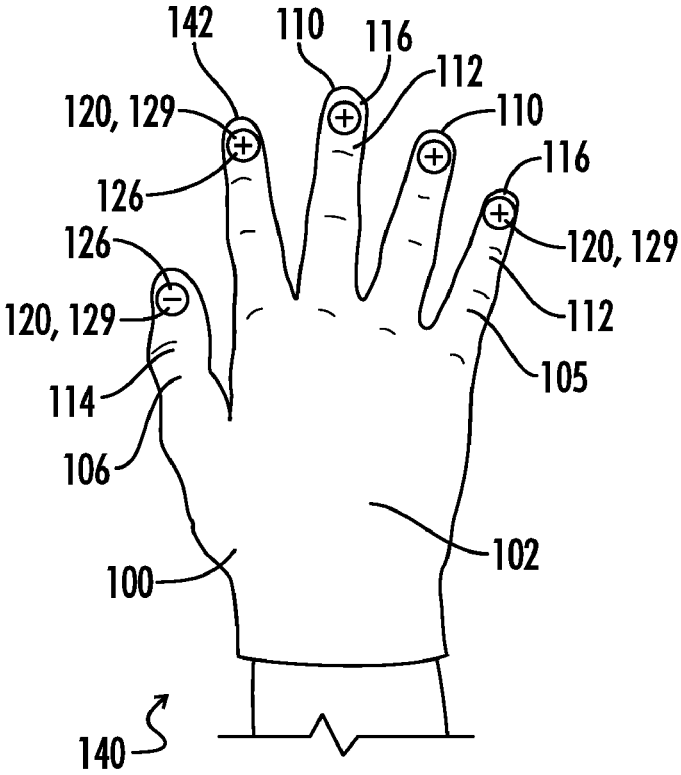
FIG. 3A depicts one embodiment of the glove type hand exercise device with opposite polarity placed on the human hand.
Figure 3B:
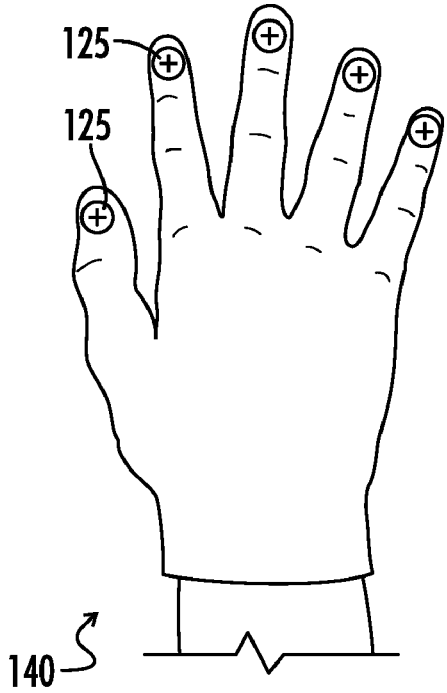
FIG. 3B depicts one embodiment of the glove type hand exercise device with similar polarity placed on the human hand.
Figure 4:
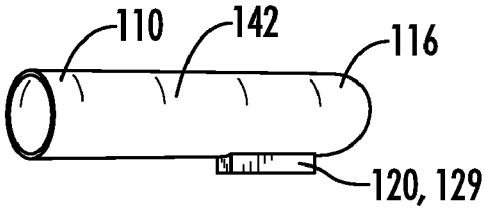
FIG. 4 is a perspective view of the hand exercise device depicting one embodiment of one separate digit sleeve with a magnet attached with the separate digit sleeve.
Figure 5:
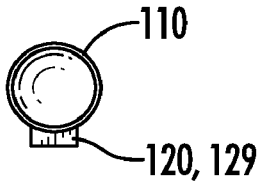
FIG. 5 is an end view of the hand exercise device depicting an embodiment of one separate digit sleeve with a magnet attached with the separate digit sleeve.
Figure 6:
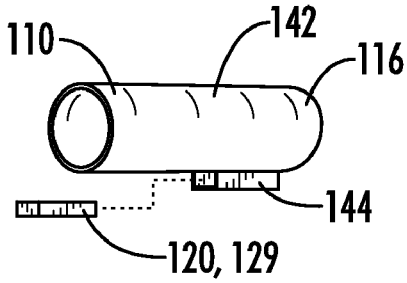
FIG. 6 is a perspective view of the hand exercise device depicting another embodiment of the separate digit sleeve with a cavity for interchanging various magnets with the separate digit sleeve.

As depicted in FIGS. 3A through 6 with the glove type 140 of digit sleeve hand exercise device 100, the separate digit sleeve 110 may include elastic or stretchable material 142 that may be cut in contoured strips and then sewn together as is typical of the fingers of a glove. The separate digit sleeve 110 will fit snugly around the finger digit 105 and the thumb digit 106 of the human hand 102. The magnetic elements 120 or magnets 129 of the separate digit sleeve 110 may be either sewn into the distal portion 116 of the separate digit sleeve 110, inserted into a pocket 144 sewn into the separate digit sleeve 110, or bonded with the separate digit sleeve 110 with adhesive. The pocket 144 attachment of the magnetic element 120 with the separate digit sleeve 110 may include a cavity or pocket 144 sewn into the separate digit sleeve 110 at the distal end 116 of the separate digit sleeve 110 such that a magnet 129 may be inserted or removed and still be snug enough to hold the magnet 129 firmly with the separate digit sleeve 110. The cavity or pocket 144 allows the interchange of magnetic elements or the adjusting of the magnet strength between weak and strong as well as removing or changing the polarity of the magnet 129. The magnetic elements 120 contained in the separate digit sleeves 110 should be of an appropriate strength to accomplish the desired exercise and rehabilitation exercise. The separate digit sleeve 110 may have as a minimum one magnetic element 120 per separate digit sleeve 110, whether finger separate digit sleeve 112 or thumb separate digit sleeve 114, with the glove type 140 configuration. As shown in FIG. 3A, another embodiment of the hand exercise device may include a plurality of separate digit sleeves 110 wherein the diameter and length are such that the separate digit sleeves 110 slide over individual digits of the human hand 102 and the separate digit sleeves 110 are in the form of a glove 140. A magnetic element 120 may be attached with each separate digit sleeve 110 on or near a distal end 116 of each separate digit sleeve 110, wherein the magnetic element 120 facilitates a desired exercise with multidirectional movements when the magnetic element 120 is approximated near a second magnetic element 122. One of the separate digit sleeves 110 may be a thumb separate digit sleeve 114 for a thumb digit 106, and the magnet 129 for the thumb separate digit sleeve 114 may be attached with the thumb separate digit sleeve 114 and orientated with an opposite polarity 126 with the magnets 129 for finger separate digit sleeves 112 for finger digits 105 such that the magnet 129 for the thumb separate digit sleeve 112 is attracted with the magnet 129 for the finger separate digit sleeve 112 such that an extension contraction exercise is produced when the thumb separate digit sleeve 114 and the finger separate digit sleeves 112 are pulled apart. As depicted in FIG. 6, with a pocket or cavity the polarity may be changed for the magnetic element. As illustrated in FIG. 3B, the polarity of the thumb separate digit sleeve 114 may be reversed wherein the thumb separate digit sleeve 114 and the finger separate digit sleeve 112 polarity may change from the opposite polarity 126 previously mentioned to a like polarity 125 such that the magnet 129 for the thumb separate digit sleeve 114 is repulsed with the magnet 129 for the finger separate digit sleeve 112 such that an erratic flexion contraction exercise is produced when the thumb separate digit sleeve 114 and the finger separate digit sleeves 112 are moved toward each other.

Magnetic Turntable:

The structure of the magnetic turntable 160 comprises an upper portion 162 and a lower portion 164 attached with a bearing 166 for turning the upper portion 162 while the lower portion 164 remains stationary. The upper portion structure 162 comprises multiple magnets 129 embedded in a top surface 163 of the upper portion 162 preferably such that the top surface 163 and the top of the magnets is a smooth surface. The upper portion 162 may further have a smooth coating over the top surface 163 such that the fingers 105 with the finger separate digit sleeves 110 do not engage ridges or valleys as they move across the top surface 163. The bearing 166 is attached with the upper and lower portion 162, 164. The bearing 166 may be adjustable for varying the force required to turn the upper portion 162 in relation to the lower portion 164. In some applications the bearing 166 and the lower portion 164 may be omitted for exercising the hand 102 and fingers 105 with a fixed instead of rotational randomly disposed magnetic field 161. The magnetic turntable 160 may be horizontal, mounted vertically or positioned at any angle between horizontal and vertical for optimum exercise, strengthening or rehabilitation for the user.

Manner of Use:

As depicted in FIGS. 2, 3A, 3B, 7, 8, 9, 16A through 18, the following list includes but does not limit the exercises that may be performed using the hand exercise device when the separate digit sleeves 110 are placed on the fingers of the user:

1. When the magnets 129 in the finger separate digit sleeves 112 are in an opposite polarity 126 with the magnet 129 in the thumb separate digit sleeve 114, the magnets 129 of the finger separate digit sleeves 112 are alternately approximated to the magnet 129 of the thumb separate digit sleeve 114 by an attractive force that pulls the magnets 129 of the finger separate digit sleeves 112 together with the magnet 129 of the thumb separate digit sleeve 114, then pulled apart to provide the extension exercise.

2. When the magnets 129 in the finger separate digit sleeves 112 are in the same or like polarity 125 with the magnet 129 of the thumb separate digit sleeve 114, the magnets 129 of the finger separate digit sleeves 112 are alternately approximated to the magnet 129 of the thumb separate digit sleeve 114 that repels the magnets 129 of the finger separate digit sleeves 112 from the magnet 129 of the thumb separate digit sleeve 114 to produce an erratic flexion exercise.

3. When all of the digits on both hands are inserted into either a finger separate digit sleeve 112 or a thumb separate digit sleeve 114, the users left and right hands are approximated towards each other whereby the users hands will be exercised against each other depending upon whether the magnets 129 of the thumb separate digit sleeves 114, the magnets 129 of the finger separate digit sleeves 112 are in a like polarity 125 or an opposite polarity 126. The finger digits 105 with the finger separate digit sleeves 112 and the thumb digit 106 with the thumb separate digit sleeve 114 are placed on a flat or waveform ferrous metal surface 150, 151, 152, then spread apart to perform the abduction exercise. The finger digits 105 with the finger separate digit sleeves 112 and the thumb digit 106 with the thumb separate digit sleeve 114 are placed on a flat or waveform ferrous metal surface 150, 151, 152, then after the abduction exercise is performed by spreading the fingers and thumb digits 105, 106 apart, the fingers and thumb digits 105, 106 are brought together to perform the adduction exercise.

4. The finger digits 105 with the finger separate digit sleeves 112 and the thumb digit 106 with the thumb separate digit sleeve 114 are placed on a waveform ferrous metal surface 152, the finger digits and thumb digits 105, 106 can then perform an abduction, adduction, flexion, extension exercise in a fluid motion without the finger digits 105 having to be repositioned to perform the different exercises.

5. The magnetic turntable 160 used with the forward and aft movement of the digits 105 as depicted in FIGS. 16A and 16B or the side-to-side movement of the digits 105 as shown in FIGS. 17A and 17B, may be used for extension and flexion movement of digits 105 as well as to generate a snap force/action at the point where the force of the approaching magnetic element 120 is greater than the force of the leaving magnetic element 120. This movement of the digits 105 may also be used to cause the magnetic turntable 160 to rotate and the force required to move the magnetic turntable 160 may be adjusted for the user as strength is developed with the hand 102 and fingers 105. In addition where the user is unable to move the fingers 105 from one magnet 129 to another, the magnetic turntable 160 may be moved by the user or another person. The person that is unable to move the fingers or digits 105 forward and aft or side-to-side may take advantage of moving the magnetic turntable 160 or having another person move the magnetic turntable 160 to cause the magnets 129 to exercise the hand 102 and fingers 105. The exercise allows the user to develop encouragement by seeing their fingers 105 begin to move again even if the magnets 129 are initially causing the movement. With time and work the user may begin to develop strength and hand 102 and finger 105 usages.

As shown in FIGS. 1 through 6, one method for exercising with a hand exercise device 100 includes, the method comprising the steps of inserting a finger digit 105 in the finger separate digit sleeve 112; inserting a thumb digit 106 in the thumb separate digit sleeve 114; moving the finger digit 105 with the finger separate digit sleeve 112 and the thumb digit 106 with the thumb separate digit sleeve 114 together; and moving the finger digit 105 with the finger separate digit sleeve 112 and the thumb digit 106 with the thumb separate digit sleeve 114 apart wherein the movement of the separate digit sleeves 110 with magnetic elements 120 provide for exercise, strength, and rehabilitation of the fingers, hands, wrists and forearms. Another method wherein the magnetic element 120 of the finger separate digit sleeve 112 and the magnetic element 120 of the thumb separate digit sleeve 114 are of opposite polarity 126 may further include the step of moving the finger digit 105 and the thumb digit 106 together by attractive forces is a pulling apart motion for extension exercises. Yet another method wherein the magnetic element 120 of the finger separate digit sleeve 112 and the magnetic element 120 of the thumb separate digit sleeve 114 are of like polarity 125 includes the step of moving the finger digit 105 and the thumb digit 106 together against the repulsive forces of the magnetic element 120 is an erratic flexion motion for exercise.

Figure 7:
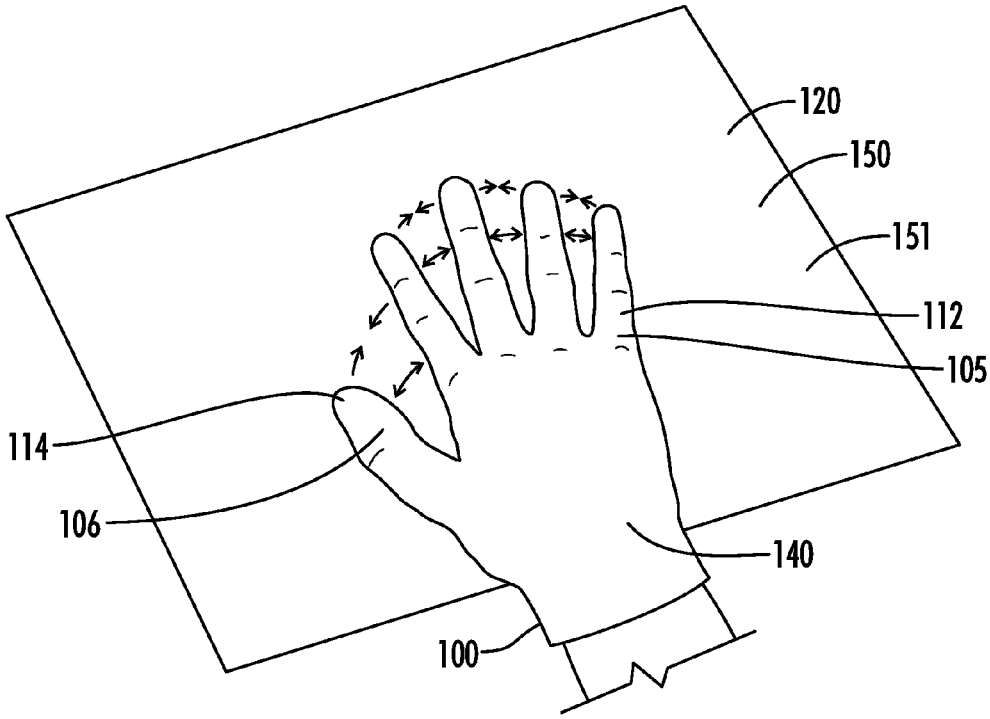
FIG. 7 depicts one embodiment of the hand exercise device and one method of using the hand exerciser on a ferrous metal surface.

As depicted in FIG. 7, another method for exercising with a hand exercise device 100 wherein one of the magnetic elements 120 is a flat ferrous metal surface 151 and the method of exercising includes the steps of: placing the finger separate digit sleeves 112 with the finger digit 105 and the thumb separate digit sleeve 114 with the thumb digit 106 on the flat ferrous metal surface 151 and moving the finger digits 105 and the thumb digit 106 together and apart.

Figure 8:
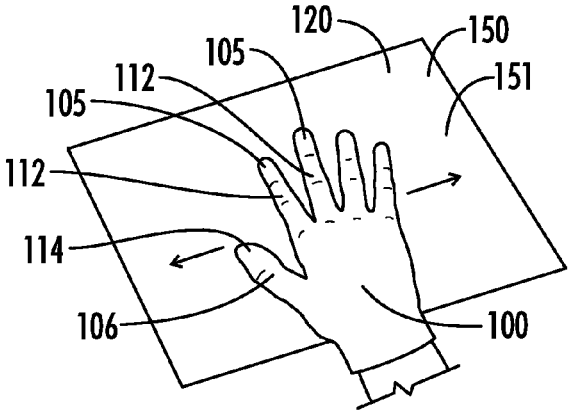
FIG. 8 shows one embodiment of the hand exercise device and one method of using the hand exerciser on a flat ferrous metal surface.

As illustrated in FIG. 8, yet another method for exercising with a hand exercise device 100 may include a glove type 140 hand exercise device 100 wherein one of the magnetic elements 120 is a flat ferrous metal surface 150, 151. The method may further comprise the steps of: inserting a finger digit 105 in the finger separate digit sleeve 112; inserting a thumb digit 106 in the thumb separate digit sleeve 114; placing the finger separate digit sleeves 112 with the finger digit 105 and the thumb separate digit sleeve 114 with the thumb digit 106 on the flat ferrous metal surface 150, 151; and moving the finger digits 105 with the finger separate digit sleeves 112 and the thumb digit 106 with the thumb separate digit sleeve 114 across the flat ferrous metal surface 150, 151.

Figure 9:
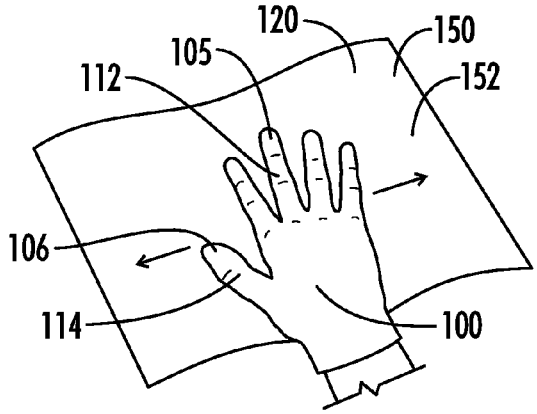
FIG. 9 illustrates one embodiment of the hand exercise device and one method of using the hand exerciser on a waveform ferrous metal surface.
Figure 10A:
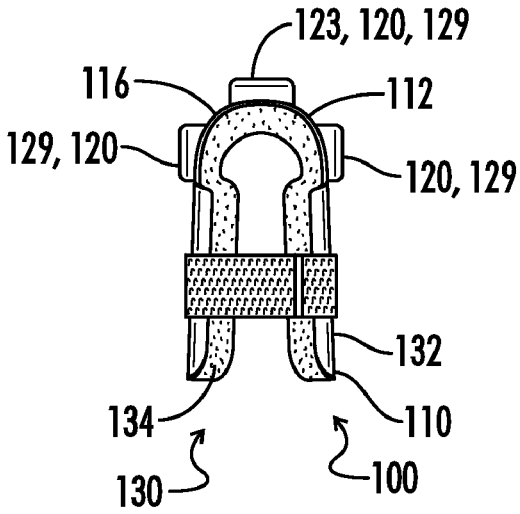
FIG. 10A is a side view of one embodiment of the splint type hand exercise device depicting a magnet on the distal tip of the splint type hand exercise device.
Figure 10B:
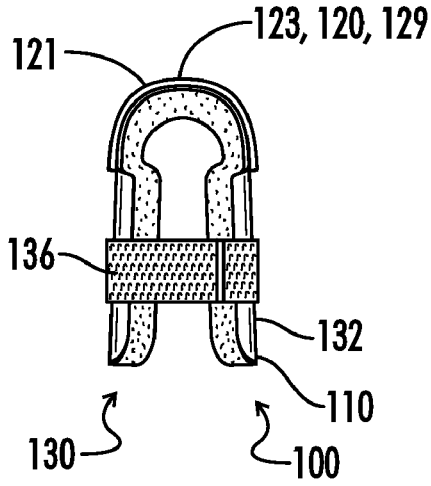
FIG. 10B is a side view of another embodiment of the splint type hand exercise device depicting a flexible magnet on the distal tip of the splint type hand exercise device.
Figure 11:
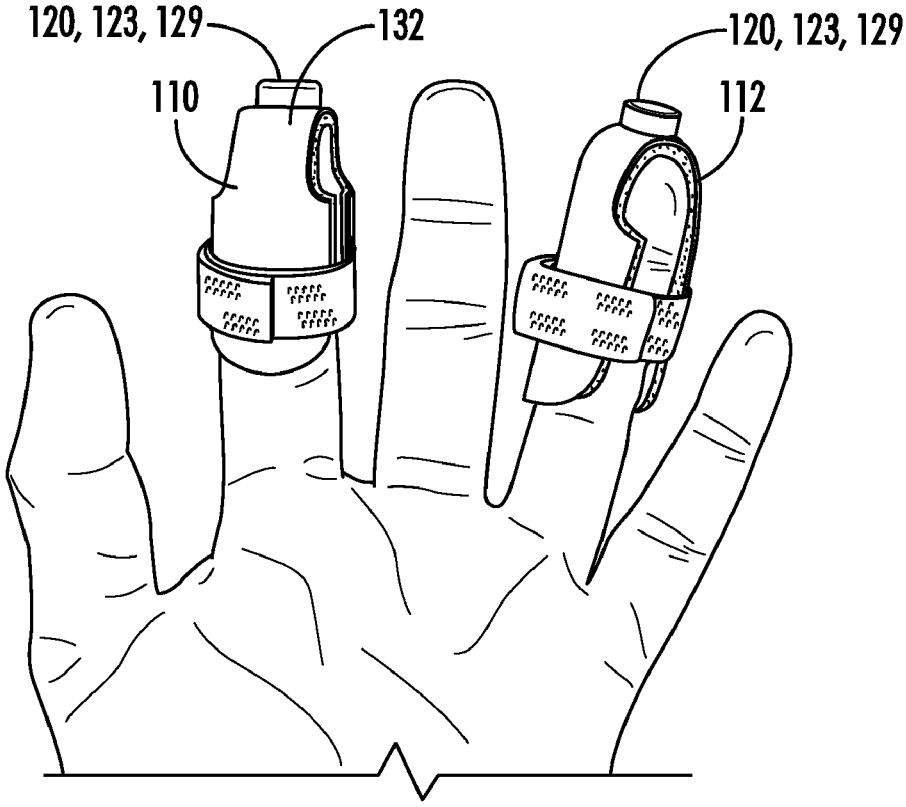
FIG. 11 is a perspective view of one embodiment of the splint type hand exercise device placed on the human hand depicting two finger sleeves one on the index finger and one on the ring finger.
Figure 12:
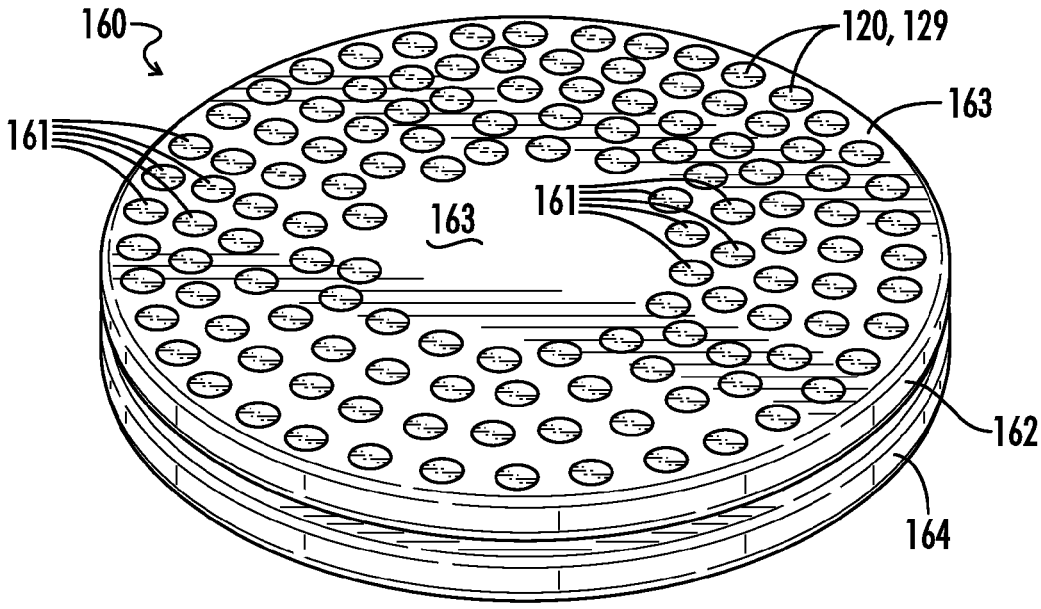
FIG. 12 is a perspective view of one embodiment of a magnetic turntable hand exercise device depicting an upper portion and a lower portion.
Figure 13:
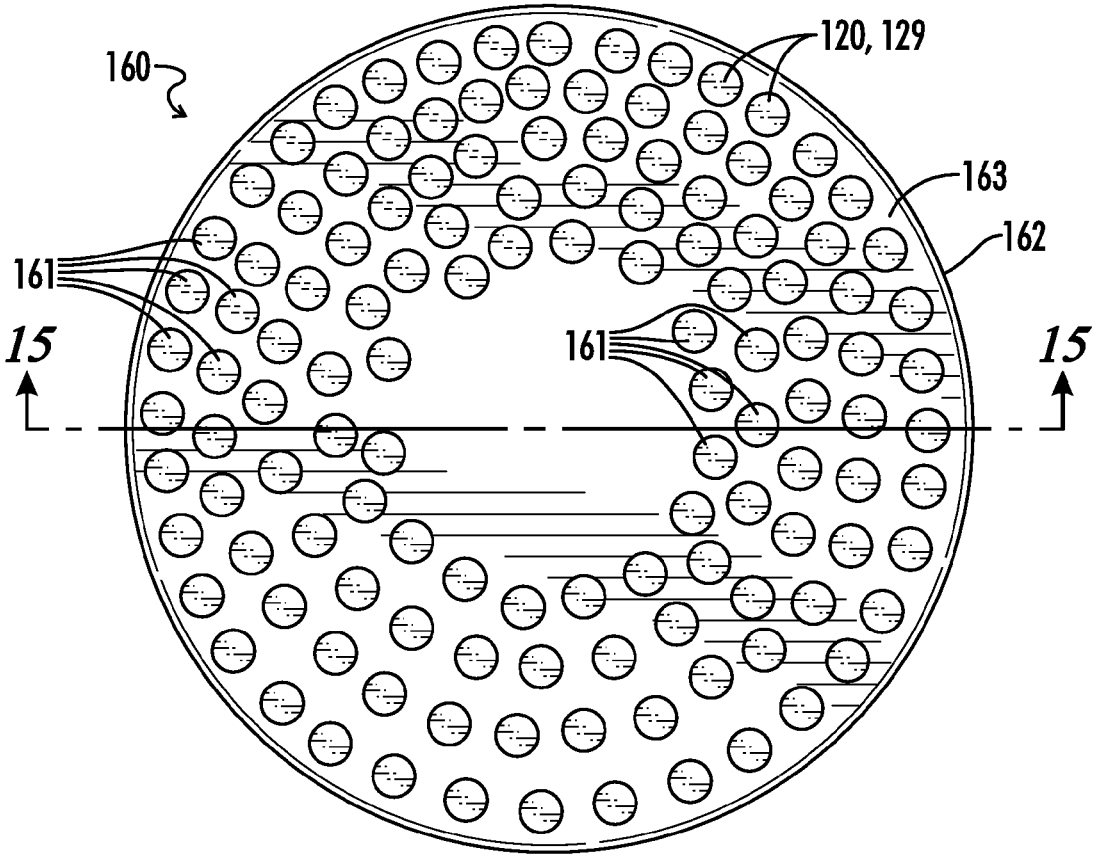
FIG. 13 is a top view of one embodiment of the magnetic turntable hand exercise device depicting magnets embedded in the top surface of the upper portion of the magnetic turntable hand exercise device.
Figure 14:
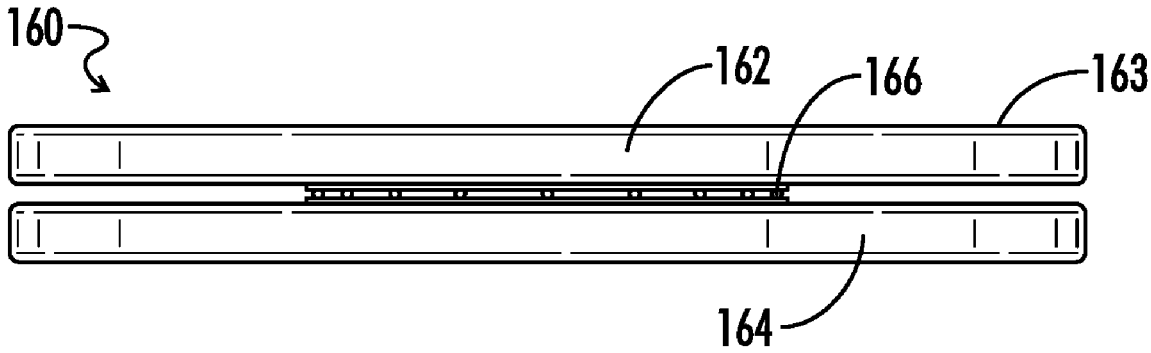
FIG. 14 is a front view of one embodiment of a magnetic turntable hand exercise device depicting an upper portion and a lower portion with a bearing between the upper and lower portion.
Figure 15:
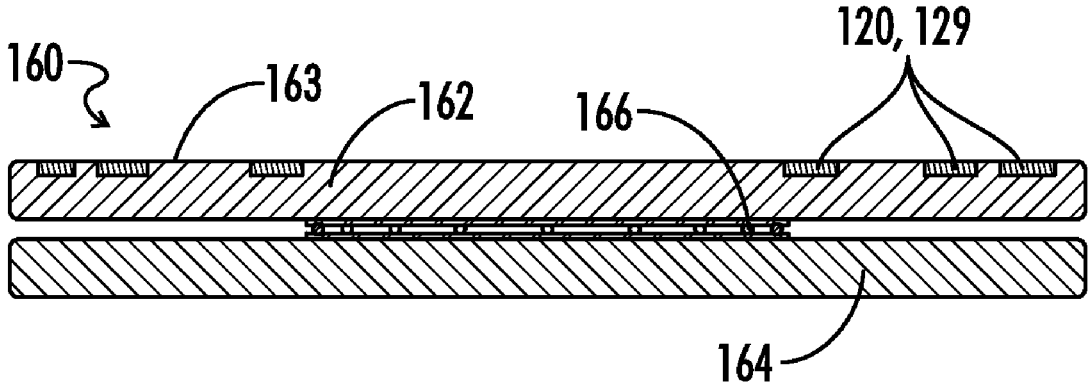
FIG. 15 is a cutaway view 15-15 of FIG. 13 depicting the upper portion and the lower portion with the bearing between the upper and lower portion.

As illustrated in FIG. 9, still another method for exercising with a hand exercise device 100 wherein one of the magnetic elements 120 is a waveform ferrous metal surface 150, 152. The method may further comprise the steps of: inserting a finger digit 105 in the finger separate digit sleeve 112; inserting a thumb digit 106 in the thumb separate digit sleeve 114; placing the finger separate digit sleeves 112 with the finger digit 105 and the thumb separate digit sleeve 114 with the thumb digit 106 on the waveform ferrous metal surface 150, 152; and moving the finger digits 105 with the finger separate digit sleeves 112 and the thumb digit 106 with the thumb separate digit sleeve 114 across the waveform ferrous metal surface 150, 152.

As shown in FIGS. 16A and 16B, a method for exercising the fingers 105 and hand 102 with a forward and aft walking of the fingers type of movement across a randomly disposed magnetic field 161. This randomly disposed magnetic field 161 may be stationary or rotational, preferably a randomly disposed magnetic turntable 160. The method comprises the steps of: inserting at least one but preferably two or more digits 105, 106 in the separate digital sleeves 112, 114; placing the hand 102 with the digits 105, 106 in the separate digital sleeves 112, 114 in the proximity of the randomly disposed magnetic field 161; moving the digits 105, 106 with the separate digital sleeves 112, 114 in a forward and aft motion similar to walking with the fingers forward and backward allowing the separate digital sleeves 112, 114 to snap between the randomly disposed magnetic fields 161 for exercise, strength and rehabilitation of the fingers, hands, wrists and forearms. This exercise may be repeated with and without rotation of the randomly disposed magnetic fields 161.

As depicted in FIGS. 17A and 17B, another method for exercising the digits 105, 106 and hand 102 with a side-to-side walking of the fingers type of movement across a randomly disposed magnetic field 161. This randomly disposed magnetic field 161 may be stationary or rotational. The method comprises the steps of: inserting at least one but preferably two or more digits 105, 106 in the separate digital sleeves 112, 114; placing the hand with the digits 105, 106 in the separate digital sleeves 112, 114 in the proximity of the randomly disposed magnetic field 161; moving the digits 105, 106 with the separate digital sleeves 112, 114 in a side to side motion similar to walking with the fingers side to side allowing the separate digital sleeves 112, 114 to snap between the randomly disposed magnetic fields 161 for exercise, strength and rehabilitation of the fingers, hands, wrists and forearms. This exercise may be repeated with and without rotation of the randomly disposed magnetic fields 161.

Figure 18:
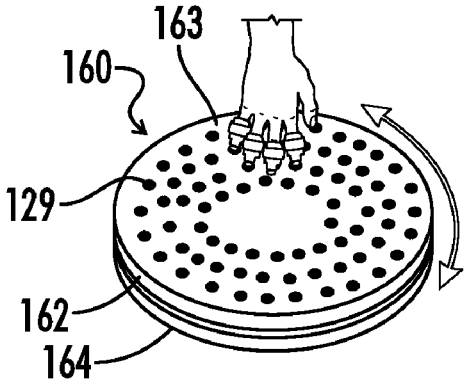
FIG. 18 is a perspective view of one embodiment of the splint type hand exercise device depicting a splint type hand exercise device exercising hand movement by the upper portion of the magnetic turntable exercise device being turned.

FIG. 18 illustrates yet another method for exercising the digits 105, 106 and hand 102 by turning a randomly disposed magnetic field 161 producing a forward and aft walking of the fingers type of movement. The method comprises the steps of: inserting at least one but preferably two or more digits 105, 106 in the separate digital sleeves 112, 114; placing the hand 102 with the digits 105, 106 in the separate digital sleeves 112, 114 in the proximity of the randomly disposed magnetic field 161; turning the randomly disposed magnetic field 161 such that the digits 105, 106 with the separate digital sleeves 112, 114 move in a motion similar to walking with the fingers as the hand 102 is held steady and the separate digital sleeves 112, 114 are attracted to and from magnets 129 with a snap action allowing the separate digital sleeves 112, 114 to snap between the randomly disposed magnetic fields 161 for exercise, strength and rehabilitation of the fingers, hands, wrists and forearms. The randomly disposed magnetic field 161 may be turned by the user or another person helping the user such as a therapist, trainer, or assistant.

Uniqueness:

The purpose of this invention is to allow the physical therapist, doctor, athlete or home user to perform all of the described exercises for the improved function, strength, training, and rehabilitation of the fingers, hands, wrists, and forearms by using only one type of hand exercise device. This hand exercise device will also allow the physical therapist to treat the patient after a stroke, injury, surgery to regain the use of the fingers, hands, wrists, forearms by using various strengths of magnets in the digit sleeves.

The methods provide exercising and strengthening of the muscles of the fingers, hands wrists, and forearms of the human arm. The methods not only exercise and strengthen the muscles of the fingers, hands, wrists, forearms but also their associated soft tissues including ligaments, tendons, cartilage, and nerves to provide rehabilitation for the fingers, hands, wrists, forearms, along with their associated soft tissue. The methods achieve a balance in all of the opposing muscle groups that must be obtained for optimal strength and function of the fingers, hands, wrists, forearms. In addition the methods reinforce and maintain the proper mechanical/structural function of the carpal tunnel by deepening the hollow in the palmar side of the hand and wrist. In addition by reinforcing the carpal tunnel to the proper function structurally and mechanically that impingement of the median nerve will be alleviated. Yet another advantage of the methods is to alleviate repetitive stress injuries by restoring the proper function of the wrists along with the surrounding supporting structures.

What is claimed is:

1. A hand exercise device for exercising human hands and thumb and finger digits comprising a magnetic turntable further comprising: an upper structural portion and a lower structural portion attached with a bearing such that the upper structural portion turns while the lower structural portion remains stationary; and the upper structural portion further comprises a top surface and multiple magnets randomly disposed and embedded in the top surface of the upper structural portion such that the top surface and the multiple magnets randomly disposed form a smooth top surface such that the digit does not engage ridges or valleys as the hand moves across the smooth top surface while exercising the hand and digit; at least one separate digit sleeve slides over at least one digit of the hand; a magnetic element is attached with each separate digit sleeve at a distal end of the each separate digit sleeve, wherein said magnetic turntable facilitates a desired exercise with multidirectional movements when the first magnetic element is approximated near said magnetic turntable.

2. The hand exercise device as set forth in claim 1 wherein the bearing is adjustable for varying a force required to turn the upper structural portion in relation to the lower structural portion.

3. A hand exercise device for exercising human hands and thumb and finger digits comprising: at least one separate digit sleeve wherein the at least one separate digit sleeve diameter and length are such that the at least one separate digit sleeve slides over at least one digit of the hand; wherein the at least one separate digit sleeve is in a form of a splint; a magnetic element is attached with each separate digit sleeve at a distal end of the each separate digit sleeve, wherein a first magnetic element facilitates a desired exercise with multidirectional movements when the first magnetic element is approximated near a second magnetic element; a top surface and multiple randomly disposed magnets wherein the multiple said randomly disposed magnets are embedded in the top surface such that as the at least one separate digit sleeve moves from one said randomly disposed magnet to the next said randomly disposed magnet a snap force occurs for exercising the hand and the digits.

4. The hand exercise device as set forth in claim 3 wherein the randomly disposed magnetic field further comprises:

an upper structural portion, a lower structural portion, and a bearing, wherein the upper structural portion and the lower structural portion are attached with the bearing such that the upper structural portion turns while the lower structural portion remains stationary; and the upper structural portion comprises the top surface and the multiple said randomly disposed magnets are embedded in the top surface of the upper structural portion such that the top surface and the multiple said randomly disposed magnets form a smooth top surface such that the digit does not engage ridges or valleys as the hand moves across the smooth top surface while exercising the hand and the digit.

5. A method for exercising with the hand exercise device as set forth in claim 4, the method comprising the steps of:

inserting the at least one digit in the at least one separate digit sleeve;

placing the hand with the at least one separate digit sleeve in a magnetic proximity of the randomly disposed magnetic field; and moving the at least one separate digit sleeve in a forward and aft motion from one said randomly disposed magnetic field to a next said randomly disposed magnetic field such that snap forces are created in the digit and provide for exercise, strength, and rehabilitation of the digit, and the hands.

6. The method for exercising as set forth in claim 5 wherein the at least one digit in the at least one separate digit sleeve is at least two digits in at least two separate digit sleeves and wherein the moving the at least one separate digit sleeve in the forward and aft motion from the one said randomly disposed magnetic field to the next said randomly disposed magnetic field step is a walking the digits type of motion wherein one of the separate sleeves is moved forward and then a next separate sleeve is moved forward and the one of the separate sleeves is moved aft and then the next separate sleeve is moved aft wherein this forward and aft motion comprises another step of rotating the upper structural portion of the randomly disposed magnetic field.

7. The method for exercising as set forth in claim 6 wherein the bearing is adjustable for varying a force required to rotate the upper structural portion in relation to the lower structural portion, further comprising an additional step of adjusting the bearing for adjusting the force required to rotate the upper structural portion of the randomly disposed magnetic field.

8. A method for exercising with a hand exercise device as set forth in claim 4, the method comprising the steps of:

inserting the at least one digit in the at least one separate digit sleeve;

placing the hand with the at least one separate digit sleeve in a magnetic proximity of the randomly disposed magnetic field; and moving the at least one separate digit sleeve in a side to side motion from one said randomly disposed magnetic field to a next said randomly disposed magnetic field such that snap forces are created in the at least one digit and provide for exercise, strength, and rehabilitation of the digits, and the hands.

9. The method for exercising as set forth in claim 8 wherein the at least one digit in the at least one separate digit sleeve is at least two digits in at least two separate digit sleeves and wherein the moving the at least one separate digit sleeve in the side to side motion from the one said randomly disposed magnetic field to the next said randomly disposed magnetic field step is a side stepping the digits type of motion wherein one of the separate sleeves is moved to a side then a next separate sleeve is moved to the side and then the one of the separate sleeve is moved to the side, repeating the side to side motion wherein the side to side motion comprises another step of rotating the upper structural portion of the randomly disposed magnetic field.

10. A method for exercising with a hand exercise device as set forth in claim 4, the method comprising the steps of:

inserting the at least one digit in the at least one separate digit sleeve;

placing the hand with the at least one separate digit sleeve in a magnetic proximity of the randomly disposed magnetic field; and moving the randomly disposed magnetic field by rotating the upper structural portion such that snap forces are created in the at least one digit providing exercise, strength, and rehabilitation of the digits, and hands for users with limited capability of movement of the digit.

11. The method for exercising as set forth in claim 10 wherein the at least one digit in the at least one separate digit sleeve is at least two digits in at least two separate digit sleeves and wherein the moving the randomly disposed magnetic field by rotating the upper structural portion step is a forward and aft motion from one randomly disposed magnetic field to a next randomly disposed magnetic field further includes a step of rotating the upper structural portion of the randomly disposed magnetic field such that the at least two separate digit sleeves is moved forward and then a next separate digit sleeve is moved forward and one of the separate sleeves is moved aft and then another separate sleeve is moved aft due to the placing of the hand over the randomly disposed magnetic field and the rotation of the randomly disposed magnetic field.

12. The method for exercising as set forth in claim 10 wherein the at least one digit in the at least one separate digit sleeve is at least two digits in at least two separate digit sleeves and wherein the moving the randomly disposed magnetic field by rotating the upper structural portion step creates a side to side motion from one randomly disposed magnetic field to a next randomly disposed magnetic field further includes a step of rotating the upper structural portion of the randomly disposed magnetic field such that the at least two separate digit sleeves is moved sideward and then a next separate digit sleeve is moved sideward due to the placing of the hand over the randomly disposed magnetic field and the rotation of the randomly disposed magnetic field.

13. A method for exercising a hand and digits of the hand with a means for hand exercise with magnetic force, a means for securing a magnet on a distal end of the digit and a randomly disposed magnetic field, the method comprising the steps of: inserting at least one digit in at least one means for securing a magnet on the distal end of the digit; providing a magnetic turntable comprising upper and lower structural portions rotatably interconnected by a bearing; providing multiple magnets embedded in the top surface of the upper portion;

placing the hand with the means for securing the magnet on the distal end of the digit in a magnetic proximity of the magnetic turntable's magnetic field; and moving the means for securing the magnet on the distal end of the digit in a forward and aft motion from a first randomly disposed magnetic field to a next randomly disposed magnetic field such that snap forces are created in the digit and provide exercise, strength, and rehabilitation of the digits, and hands.

* * * * *